United States Patent [19]

Bouchard

[11] 4,382,775

[45] May 10, 1983

[54] MINIATURE PHOTOFLASH LAMP AND METHOD OF MAKING

[75] Inventor: Andre C. Bouchard, Peabody, Mass.

[73] Assignee: GTE Products Corporation, Stamford, Conn.

[21] Appl. No.: 346,990

[22] Filed: Feb. 8, 1982

Related U.S. Application Data

[63] Continuation of Ser. No. 96,606, Nov. 21, 1979, abandoned.

[51] Int. Cl.[3] ..... F21K 5/02

[52] U.S. Cl. ..... 431/362

[58] Field of Search ..... 431/357, 358, 362, 365; 316/17

[56] References Cited

U.S. PATENT DOCUMENTS

| | | | |
|---|---|---|---|
| 2,305,561 | 12/1942 | Sylvester | 431/362 |
| 2,791,111 | 5/1957 | Gleim | 431/362 |
| 2,798,368 | 7/1957 | Anderson | 431/362 |
| 3,220,224 | 11/1965 | Baird | 431/360 |
| 3,310,968 | 3/1967 | Buzalski | 431/362 |
| 3,535,063 | 10/1970 | Anderson et al. | 431/361 |
| 3,751,656 | 8/1973 | Buckler et al. | 431/362 |
| 3,817,683 | 6/1974 | Weber | 431/362 |
| 3,893,798 | 7/1975 | Sterling | 431/362 |

*Primary Examiner*—Samuel Scott
*Assistant Examiner*—Lee E. Barrett
*Attorney, Agent, or Firm*—Lawrence R. Fraley

[57] ABSTRACT

A miniature photoflash lamp which includes a plastic, light-transmitting envelope and a quantity of a flash-producing composition therein. The composition includes a powdered metal (e.g., zirconium) and a powdered oxidizer (e.g., potassium chlorate) with the powdered metal having a particle size within the range of about 10 to 150 microns. Activation of the lamp may be accomplished electrically using, for example, a pair of conductive lead-in wires sealed within one end of the envelope. A method for making this lamp is also described.

12 Claims, 2 Drawing Figures

MINIATURE PHOTOFLASH LAMP AND METHOD OF MAKING

This is a continuation of application Ser. No. 96,606, filed Nov. 21, 1979, now abandoned.

CROSS REFERENCE TO COPENDING APPLICATION

In Ser. No. 096,605, now U.S. Pat. No. 4,315,733, entitled "Photoflash Lamp with Loose Powder Composition and Method of Making" (Inventors: A.C. Bouchard et al), there is described a miniature photoflash lamp and method of making same wherein the lamp includes a powdered flash-producing composition held in place within the lamp's envelope by a frictionally inserted disk (or wad). Ser. No. 096,605 was filed Nov. 21, 1979 and is assigned to the same assignee as the instant invention.

TECHNICAL FIELD

The invention relates to photoflash lamps and particularly to photoflash lamps of the miniature variety (those having an internal volume of about 1.0 cubic centimeter or less). Even more particularly, the invention relates to lamps of this variety which are electrically activated.

BACKGROUND

Examples of known miniature photoflash lamps are described in U.S. Pat. Nos. 3,817,683 (Weber) and 3,893,798 (Sterling). Such lamps typically include an all-glass envelope, electrical ignition means including a pair of lead-in wires spacedly oriented within a base of the envelope with each wire having a quantity of primer material located on an end thereof and joined to the other primer material by a linear electrical filament, a quantity of shredded, combustible foil (e.g., zirconium, aluminum, hafnium, or thorium), and a pressurized, combustion-supporting atmosphere (e.g., oxygen) within the envelope. Understandably, it is essential that the envelope is hermetically sealed in order to contain the atmosphere and assure operability of the lamp.

It will be understood from the following that one of the primary objects of the instant invention is to provide a new and unique photoflash lamp which eliminates the need for the aforedescribed sealed glass envelope and shredded foil elements, as well as the pressurized atmosphere associated therewith, while still providing an intense light output more than sufficient to meet the requirements of many of today's higher speed films. The lamp as defined herein is thus much less expensive to manufacture than existing miniature lamps and also has proven both safe and reilable in operation.

Prior to development of the above, known miniature lamps, photoflash lamps were produced which did not require shredded foil or similar combustible materials but instead utilized a flash-producing material such as a combination of zirconium and an oxidant (e.g., potassium chlorate, barium nitrate, or strontium nitrate). One such example is described in U.S. Pat. No. 3,220,224 (Baird). It was believed essential in these products, however, that the particle size of the flash-producing material (particularly that of the zirconium) must be very small or "finely divided". As described in U.S. Pat. No. 3,220,224, the optimum particle size for the zirconium is approximately 1.8 microns while that of the oxidant should not exceed 8.5 microns (optimum being 4–5.5 microns). It was also deemed essential that the ratio of flash-producing material to total internal volume of the lamp's envelope remain small for safety purposes. Accordingly, these earlier lamps required relatively large envelopes (e.g., 7–8 cubic centimeters) to accommodate the correspondingly large quantities of flash-producing material necessary for adequate light output and were not, therefore, adaptable to miniaturization and the advantages inherent therewith.

It is believed, therefore, that a miniature photoflash lamp which can provide the several advantages cited above without adversely affecting safety, manufacture, or light output would constitute a significant advancement in the art.

DISCLOSURE OF THE INVENTION

As stated, it is a primary object of the present invention to provide a miniature photoflash lamp which eliminates the need for a hermetically-sealed glass envelope, shredded combustible material, and pressurized combustion-supporting atmosphere while still assuring user safety, ease of manufacture, and output levels which match the requirements of today's higher speed films (e.g., ASA 400).

It is another object of this invention to provide such a lamp wherein the ratio of flash-producing material to internal volume of the lamp's envelope can be maintained at relatively high levels while still assuring containment of this material during lamp activation.

Still another object of this invention is to provide a new and unique means for providing electrical ignition of the above lamp.

An even further object of the invention is to provide a method for making a miniature photoflash lamp possessing the aforedefined capabilities.

These objects are accomplished in one aspect of the invention by the provision of a miniature photoflash lamp having a light-transmitting envelope, a flash-producing composition located within the envelope, and means for igniting the composition. The lamp's light output is provided by the ignited flash-producing composition which comprises both a powdered metal and a powdered oxidizer. The powdered metal (e.g., zirconium) has a particle size within the range of about 10 to 150 microns.

The above objects are accomplished in another aspect of the invention by provision of a method for making a miniature photoflash lamp which comprises positioning and sealing electrical ignition means within one end of the tubular member, locating a quantity of a flash-producing composition within the tubular member through a second, open end thereof, and thereafter sealing the second, open end.

BEST MODE FOR CARRYING OUT THE INVENTION

For a better understanding of the present invention together with other and further objects, advantages and capabilities thereof, reference is made to the following disclosure and appended claims in connection with the above described drawings.

Figure 1:
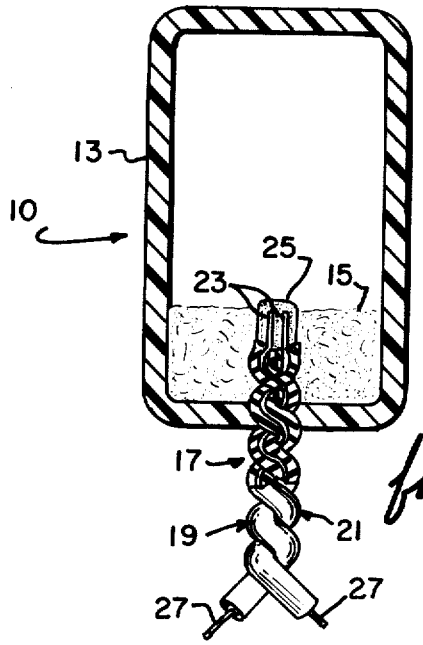
FIG. 1 is an elevational view, in section, of a miniature photoflash lamp in accordance with a preferred embodiment of the invention.
Figure 2:
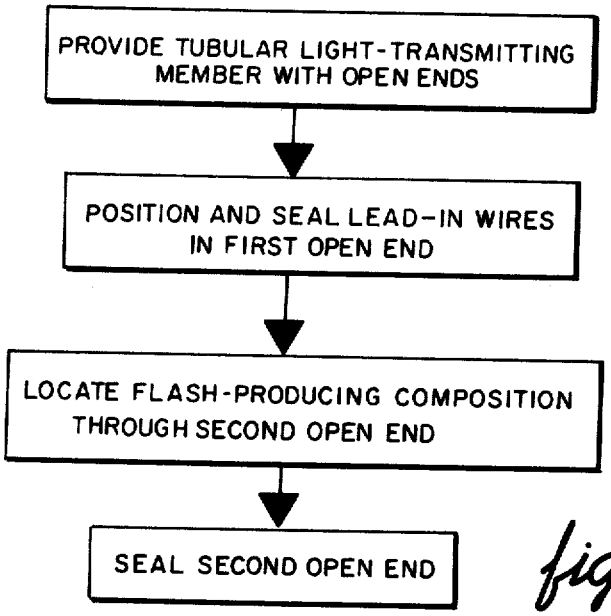
FIG. 2 represents a flow diagram of the steps of producing a miniature photoflash lamp in accordance with the teachings of the invention.

With particular reference to FIG. 1, a miniature photoflash lamp 10 is shown as including a light-transmitting envelope 13, a flash-producing composition 15 within envelope 13 for providing the light output for lamp 10 upon ignition thereof, and ignition means 17 for igniting composition 15 to provide said output. By the term miniature is meant a lamp having an envelope with an internal volume no greater than about 1.0 cubic centimeter. Envelope 13 is preferably cylindrical (tubular), and in one embodiment of the invention possessed an internal diameter of about 0.343 centimeter, an internal length of about 10.00 centimeters, and a wall thickness of about 0.127 centimeter. The preferred material for envelope 13 is plastic (polypropylene) which, having the above dimensions, results in the envelope being translucent. It is understood, of course, that other plastic materials and dimensional variations are possible, including those which provide a transparent vessel. It is also possible to use glass as the envelope material.

Flash-producing composition 15 comprises a predetermined quantity of a powdered metal (serving as the fuel) and a predetermined quantity of oxidizer (serving as the oxygen supplier). The preferred powdered metal material is zirconium while the preferred oxidizer materia is potassium chlorate. Other acceptable oxidizers include potassium perchlorate and sodium chlorate while another acceptable metal is hafnium.

As described above, one of the primary features of the instant invention is the use of a relatively large particle size metal powder as a key ingredient of the powdered flash-producing composition (15). It was found that zirconium powders having particle sizes ranging from about 10 to about 150 microns could be successfully used to provide desired light outputs without sacrificing containment of the finished product's envelope. Improvements in color temperature were also attained using these particles, and it was possible to readily adjust flash duration times. It was also found that large fuel particles, when combined with the aforedescribed oxidizers and positioned within the above envelope, burned at higher temperatures, emitted more light per unit weight, caused less pressure build-up, burned in a more localized manner, and were considerably less hazardous to handle, than similar mixtures containing fuels having "finely divided" (e.g., 1.8 microns) particles. Obviously, the above features are deemed truly significant in the photoflash lamp field.

When using the above zirconium powder, it was preferred to use an oxidizer having a particle size within the range of about 70 to about 150 microns. It is understood, however, that smaller sizes (e.g., 10 microns) could be used without adversely affecting the benefits derived from the present invention. Several successful combinations of the above materials are provided below.

The utilization of a plastic envelope 13 is possible when above flash-producing combination 15 is employed due to the lack of need for a combustion-supporting atmosphere within the envelope. Accordingly, it is not necessary to hermetically seal envelope 13 as is required for lamps containing combustible foils and similar materials. For ease of manufacture, however, envelope 13 contains an atmosphere of air which in effect serves to support combustion. Permitting air to remain in the envelope during formation thereof eliminates the costly procedures of either extracting such atmosphere (e.g., to form a vacuum) or injecting same at high pressures, as typically required in known miniature lamps.

It was determined that the aforedefined fuels, when used in plastic vessel lamps, should radiate at color temperatures of at least 4000 degrees K. The finished lamps of the instant invention were all capable of attaining these desired levels. It was also possible to obtain light outputs approaching 500 lumen seconds and, by varying the fuel-oxidizer ratios, to vary the pulse (flash) duration of the output from about 5 to 30 milliseconds. Specifically, increasing the oxidizer content resulted in flash durations approaching the higher time values while excess fuel material produced short durations. Use of large particle fuels in an air-containing plastic envelope further permitted employment of large quantities of composition 15, in comparison to existing miniature lamps. For example, it was possible to successfully utilize flash-producing compositions weighing from about 25 to about 35 milligrams in a 1.0 cubic centimeter envelope. Higher ratios (composition: envelope volume) are attainable when using smaller sized envelopes.

Ignition means 17 is shown in FIG. 1 as including a pair of conductive lead-in wires 19 and 21 each having an 0.03 centimeter diameter copper wire covered by a 0.005 centimeter insulative coating. Wires 19 and 21 are twisted about each other (about 4 turns per centimeter) into the configuration shown and sealed within a bottom (end) portion of envelope 13. Understandably, it is also possible to secure these members within one of the envelope's side walls or within the opposing, upper end. Exposed ends 23 of wires 19 and 21 extend within envelope 13 approximately 0.318 centimeter and include thereon a quantity of primer material 25. As shown, ends 23 are spacedly oriented with portions of primer 25 located therebetween. Application of ignition voltage across the protruding ends 27 of wires 19 and 21 by a suitable power source (e.g., a piezoelectric element) typically associated with many of today's cameras results in generation of a spark across ends 23 and instantaneous ignition of primer 25. A typical ignition voltage is about 3000 volts. The deflagrating primer 25 in turn ignites powdered composition 15. It is preferred that primer 25 be located within composition 15 or protrude slightly therefrom as illustrated in FIG. 1. It is possible to eliminate primer 25 in the present invention and directly ignite composition 15 using the spark generated between ends 23 of wires 19 and 21. In such an arrangement, ends 23 are thus defined as being in operative engagement with composition 15 (e.g., by being inserted therein). It is preferred, however, to utilize primer 25 in that less energy will be required to achieve ignition of lamp 10. One example of a primer material successfully used included about 78 percent zirconium powder, 16 percent potassium perchlorate, 4 percent Alon C, and 2 percent nitrocellulose. Another suitable example included 50 percent zirconium, 30 percent potassium perchlorate, 10 percent tungstic oxide, 4 percent Alon C, 4 percent glass beads, and 2 percent nitrocellulose. All of the above percentages are by weight of the mixture. Methyl cellulose acetate was used as a solvent in preparation of both of the defined primers. Application of primer to the ends 23 of wires 19 and 21 was achieved by dipping these ends into the liquid suspension and withdrawing slowly (e.g., 0.635 centimeter per second). The coated ends were then sealed within the end of envelope 13 as illustrated. Approximately 0.5 to 1.0 milligram of primer was utilized in lamp 10.

Although it has been shown and described to ignite composition 15 electrically, it is also within the scope of the invention to utilize percussively actuated means for this purpose. By way of example, a metal primer tube such as described in U.S. Pat. No. 3,535,063 (Anderson et al) could be employed and project from the bottom end of envelope 13. Deformation of the tube would result in deflagration of the fulminating material therein up through the tube and ignition of composition 15 located within the envelope 13 in a similar manner to that depicted in FIG. 1. The teachings of U.S. Pat. No. 3,535,063, are thus incorporated herein by reference.

The following represent several examples of miniature photoflash lamps made in accordance with the teachings of the invention. In all of these examples, the upper portion (approximately 9 centimeters of the envelope's length) of envelope 13 was optically darkened (masked) and the defined light output readings were taken from only the remaining "active" light-transmitting region of the envelope. It is understood from the above that composition 15 occupies this region and that the optically darkened portion thus represents an expansion chamber for gases generated during ignition. In summary, the "active" region emits a relatively large proportion of the lamp's total output due primarily to the beneficial results of using large grain size fuels which assure localized burning. Accordingly, the total light output of the invention will be greater than that indicated below wherein optical masking was used on envelope 13.

EXAMPLE I

Flash-producing composition: 15.9 milligrams zirconium powder (particle size: 15–20 microns) and 14.1 milligrams potassium chlorate powder (particle size: 15–20 microns) and 14.1 milligrams potassium chlorate powder (particle size: less than 74 microns).

Illumination: 240 lumen seconds

Pulse Duration: 5–7 milliseconds.

Color Temperature: about 4200 degrees K.

Containment: excellent.

EXAMPLE II

Flash-producing composition: 15.9 milligrams zirconium powder (particle size: 15–20 microns) and 14.1 milligrams potassium chlorate powder (particle size: 74–149 microns).

Illumination: 400 lumen seconds.

Pulse Duration: 10–12 milliseconds.

Color Temperature: about 4200 degrees K.

Containment: excellent.

EXAMPLE III

Flash-producing composition: 15.9 milligram zirconium powder (particle size: 44–74 microns) and 14.1 milligrams potassium chlorate powder (particle size: 74–149 microns).

Illumination: 350 lumen seconds.

Pulse Duration: 20 milliseconds.

Color Temperature: about 4200 degrees K.

Containment: excellent.

EXAMPLE IV

Flash-producing composition: 15.9 milligrams zirconium powder (particle size: 44–74 microns) and 14.1 milligrams potassium chlorate powder (particle size: less than 74 microns).

Illumination: 450 lumen seconds

Pulse Duration: 20 milliseconds.

Color Temperature: about 4200 degrees K.

Containment: excellent.

EXAMPLE V

Flash-producing composition: 15.9 milligrams zirconium powder (particle size: 74–149 microns) and 14.1 milligrams potassium chlorate powder (particle size: less than 74 microns).

Illumination: 370 lumen seconds.

Pulse Duration: 30 milliseconds.

Color Temperature: about 4200 degrees K.

Containment: excellent.

The aforedescribed dual wire electrical ignition means (including primer) was used to ignite the described flash-producing compositions. A piezoelectric element served as the requisite voltage source.

In addition to the above, examples were made wherein the zirconium powder had a particle size less than 10 microns (e.g., 3 microns). Ignition of the lamps resulted in rupture of the plastic envelope.

The above lamps were each produced by initially providing a piece of elongated, polypropylene tubing having opposed (first and second) open ends and the described internal diameter (0.343 centimeter). The dual-wired electrical ignition means 17, with the wires 19 and 21 twisted together and having primer 25 thereon, was inserted within a first open end of the tube and said end sealed. Sealing was achieved using a heated aluminum block having a recessed (concave) portion with an aperture centrally located therein and passing through the block. Wires 19 and 21 were oriented within the block's aperture to extend within the recessed portion whereupon the polypropylene tubing was lowered about the wiring until engagement was effected between the recess and the tube's first open end. A small force was then exerted at the opposing, second open end of the tubing such that the first end was pressed aginst the block and deformed about the contained wiring. The tubing, now having ignition mears 17 secured therein, was removed from the aluminum block and oriented vertically. The described quantity of flash-producing composition 15 was then dropped (using a funnel) into the upright tubing through the second open end. The composition fell to the bottom (first end) to surround the extending ends of wires 19 and 21 in the manner shown in FIG. 1. Positioning of composition 15 can be facilitated by moisture-dampening (e.g., using water) the composition prior to insertion. Such dampening resulted in a more homogeneous mixture (less particle segregation) than a simple dry (loose) mixture of the same material, particularly when using the larger, coarser grains. When dampening was used, the tubular members were located in an oven and dried (100 degrees C. for about 10 minutes) prior to subsequent processing.

The next step in producing lamps 10 involved sealing the remaining (or second) open end. This process simply involved inserting the second end within the recess of the aforedescribed, heated aluminum block until closure was accomplished and a completed envelope was defined.

It is understood that the above process will result in the surrounding atmosphere present during the last sealing step to become confined within the envelope, unless preventative steps (e.g., vacuum drawing) are taken. In a typical working environment, this atmosphere will obviously comprise air, an atmosphere totally satisfactory for permitting combustion of the invention's flash-producing composition therein. This air will also be at normal atmospheric pressure when located therein and not at much higher pressures as typically required in known miniature lamps. Accordingly, the invention can be readily produced with less cost and difficulty than methods utilized in producing current miniature lamps which utilize combustible shred material. Furthermore, it is understood that envelope 13 needn't be completely (hermetically) sealed at either end as is required in the above, combustible-type lamps containing a pressurized, oxygen atmosphere therein.

While there have been shown and described what are at present considered the preferred embodiments of the invention, it will be obvious to those skilled in the art that various changes and modifications may be made therein without departing from the scope of the invention as defined by the appended claims.

I claim:

1. An electrically activated, miniature photoflash lamp comprising:

a light-transmitting envelope having an internal volume equal to or less than about one cubic centimeter;

a flash-producing composition located within said envelopefor burning in a substantially localized manner to provide a flash of light upon ignition thereof, said composition including a predetermined quantity of a powdered metal material and a predetermined quantity of a powdered oxidizer material, said powdered metal material having a particle size within the range of from about 10 to about 150 microns; and means for electrically igniting said flash-producing composition, said means extending within said envelope and in contact with said flash-producing composition and comprising a pair of conductive lead-in wires each having an insulative coating thereon and an exposed conductive end portion extending within said envelope, said lead-in wires twisted about each other and secured within a wall or end portion of said envelope.

2. The photoflash lamp according to claim 1 wherein the material for said envelope is selected from the group consisting of glass and plastic.

3. The photoflash lamp according to claim 2 wherein said plastic is polypropylene.

4. The photoflash lamp according to claim 1 wherein said powdered metal material is selected from the group consisting of zirconium or hafnium.

5. The photoflash lamp according to claim 1 wherein said powdered oxidizer is selected from the group consisting of potassium chlorate, potassium perchlorate, and sodium chlorate.

6. The photoflash lamp according to claim 1 wherein the ratio of said flash-producing composition to the internal volume of said envelope is within the range of about 25 milligrams per cubic centimeter to about 35 milligrams per cubic centimeter.

7. The photoflash lamp according to claim 1 wherein said powdered oxidizer material has a particle size within the range of from about 70 microns to about 150 microns.

8. The photoflash lamp according to claim 1 further including a combustion-supporting atmosphere within said envelope, said atmosphere comprised of air.

9. The photoflash lamp according to claim 1 further including a quantity of primer material positioned on said exposed, conductive end portions of said lead-in wires and in contact with said flash-producing composition for igniting said composition, said conductive end portions and said primer material positioned substantially within said flash-producing composition.

10. A method of making a miniature, electrically-activated photoflash lamp, said method comprising:

providing a tubular, light-transmitting member having first and second open ends;

positioning a pair of conductive lead-in wires each having an insulative coating thereon and twisted about each other within said first of said open ends and sealing said first open end with said twisted wires therein such that an end portion of each of said wires extends within said tubular member;

positioning a quantity of flash-producing composition within said second open end of said tubular member and in contact with said extending end of said lead-in wires, said composition including a predetermined quantity of a powdered metal material and a powdered oxidizer material for burning in a substantially localized manner to provide a flash of light upon ignition thereof, said powdered metal material having a particle size within the range of about 10 microns to about 150 microns; and sealing said second open end of said tubular member to define a light-transmitting envelope, said envelope having an internal volume equal to or less than abut one cubic centimeter.

11. A method according to claim 10 further including providing a quantity of primer material on said extending ends of said lead-in wires prior to positioning said flash-producing composition within said tubular member.

12. The method according to claim 10 further including adding a combustion-supporting atmosphere within said tubular member through said second end of said tubular member immediately prior to sealing said second end.

* * * * *